US010311832B2

(12) United States Patent
Lee et al.

(10) Patent No.: US 10,311,832 B2
(45) **Date of Patent: *Jun. 4, 2019**

(54) SYSTEM-ON-CHIP (SOC) DEVICES, DISPLAY DRIVERS AND SOC SYSTEMS INCLUDING THE SAME

(71) Applicant: Samsung Electronics Co., Ltd., Suwon-si, Gyeonggi-do (KR)

(72) Inventors: Jong-Hyup Lee, Seoul (KR); Kyoung-Man Kim, Suwon-si (KR)

(73) Assignee: Samaung Electronics Co., Ltd., Gyeonggi-Do (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/991,227

(22) Filed: May 29, 2018

(65) Prior Publication Data

US 2018/0277061 A1 Sep. 27, 2018

Related U.S. Application Data

(63) Continuation of application No. 14/850,270, filed on Sep. 10, 2015, now Pat. No. 10,008,182.

(60) Provisional application No. 62/049,508, filed on Sep. 12, 2014.

(30) Foreign Application Priority Data

Nov. 27, 2014 (KR) ..... 10-2014-0167569

(51) Int. Cl.

| | |
|---|---|
| ***G09G 3/20*** | (2006.01) |
| ***G09G 3/36*** | (2006.01) |
| ***G09G 5/00*** | (2006.01) |
| ***G09G 5/12*** | (2006.01) |
| ***G09G 5/18*** | (2006.01) |
| ***G09G 5/36*** | (2006.01) |

(Continued)

(52) U.S. Cl.

CPC ..... *G09G 5/12* (2013.01); *G09G 3/2096* (2013.01); *G09G 3/3648* (2013.01); *G09G 3/3685* (2013.01); *G09G 5/006* (2013.01); *G09G 5/18* (2013.01); *G09G 5/363* (2013.01); *G09G 5/39* (2013.01); *G09G 5/393* (2013.01); *G09G 2330/021* (2013.01); *G09G 2330/022* (2013.01); *G09G 2360/18* (2013.01)

(58) Field of Classification Search

None

See application file for complete search history.

(56) References Cited

U.S. PATENT DOCUMENTS

| | | | |
|---|---|---|---|
| 6,943,782 | B2 | 9/2005 | Tamura |
| 7,123,246 | B2 | 10/2006 | Nakatani et al. |
| 7,598,959 | B2 | 10/2009 | Kardach et al. |

(Continued)

*Primary Examiner* — Xin Sheng

(74) *Attorney, Agent, or Firm* — Harness, Dickey & Pierce, P.L.C.

(57) ABSTRACT

A system-on-chip (SoC) device includes: a display controller configured to receive a trigger signal, and to output image data based on the trigger signal; and a transceiver configured to receive a first interrupt. In a first mode, the display controller is configured to output the image data in synchronization with a pulse of the trigger signal. In a second mode, which is different from the first mode, the display controller is configured to output the image data in synchronization with a pulse included in the trigger signal only after receiving the first interrupt.

18 Claims, 13 Drawing Sheets

(51) Int. Cl.
*G09G 5/39* (2006.01)
*G09G 5/393* (2006.01)

(56) References Cited

U.S. PATENT DOCUMENTS

| | | | | |
|---|---|---|---|---|
| 7,692,642 | B2 | 4/2010 | Wyatt | |
| 8,963,936 | B1 * | 2/2015 | Khoury | G09G 5/36 345/531 |
| 2010/0245316 | A1 | 9/2010 | Cheng | |
| 2011/0175874 | A1 * | 7/2011 | Wakimoto | G09G 3/3406 345/207 |
| 2012/0098844 | A1 | 4/2012 | Song et al. | |
| 2012/0162159 | A1 * | 6/2012 | Kim | G09G 3/3233 345/204 |
| 2013/0235941 | A1 | 9/2013 | Koo et al. | |
| 2014/0055476 | A1 | 2/2014 | Wang | |
| 2014/0198138 | A1 | 7/2014 | Nambi et al. | |
| 2015/0002381 | A1 * | 1/2015 | Fujioka | G09G 3/3614 345/87 |

* cited by examiner

SYSTEM-ON-CHIP (SOC) DEVICES, DISPLAY DRIVERS AND SOC SYSTEMS INCLUDING THE SAME

CROSS-REFERENCE TO RELATED APPLICATION(S)

This application is a Continuation of U.S. application Ser. No. 14/850,270, filed on Sep. 10, 2015, which claims priority under 35 U.S.C. § 119 to provisional U.S. Patent Application No. 62/049,508 filed on Sep. 12, 2014 in the U.S. Patent and Trademark Office, and to Korean Patent Application No. 10-2014-0167569 filed on Nov. 27, 2014 in the Korean Intellectual Property Office, the entire contents of each of which are incorporated herein by reference.

BACKGROUND

Field

One or more example embodiments of inventive concepts relate to system-on-chip (SoC) devices, display drivers and/or SoC systems comprising the same.

Description of the Related Art

With increases in image resolution, data traffic between mobile application processors and display driver integrated circuits (ICs) as well as power consumption by mobile application processors and/or display driver ICs has also increased. Accordingly, research into methods for reducing power consumption is under way.

SUMMARY

One or more example embodiments of inventive concepts provide system on chip (SoC) devices having reduced power consumption when driven to output images.

One or more example embodiments of inventive concepts also provide display drivers having reduced power consumption when driven to output images.

One or more example embodiments of inventive concepts also provide SoC systems having reduced power consumption when driven to output images.

Inventive concepts will be described in or be apparent from the following description of some example embodiments.

At least one example embodiment provides a system-on-chip (SoC) device comprising: a display controller configured to receive a trigger signal, and to output image data based on the trigger signal; and a transceiver configured to receive a first interrupt. In a first mode, the display controller is configured to output the image data in synchronization with a pulse of the trigger signal. In a second mode, which is different from the first mode, the display controller is configured to output the image data in synchronization with the pulse of the trigger signal only after receiving the first interrupt.

According to at least some example embodiments, the image data may include moving image data in the first mode, and/or the image data may include still image data in the second mode.

In the first mode, the display controller may be configured to output the image data n times per second, where n is a natural number. In the second mode, the display controller may be configured to output the image data m times per second, where m is a natural number less than n.

The transceiver may be further configured to receive the trigger signal from a display driver. The display driver may be configured to generate an image signal based on the image data output from the display controller, and to supply the generated image signal to a display panel.

The transceiver may be further configured to receive the first interrupt in synchronization with the trigger signal.

The transceiver may be configured to receive the first interrupt in synchronization with a first pulse of the trigger signal, and the display controller may be further configured to output the image data in synchronization with a second pulse of the trigger signal, the second pulse being different from the first pulse.

The image data may be stored in an external memory, and the display controller may be further configured to control the external memory to output the image data in synchronization with the pulse of the trigger signal.

The display controller may be configured to switch from the first mode to the second mode in response to consecutive output of the same image data p times in the first mode. In this case, p is a natural number greater than or equal to 2.

The display controller may be further configured to operate in the second mode based on the first interrupt received at the transceiver, and the display controller may be further configured to switch from the second mode to the first mode in response to transmission of a second interrupt by the transceiver. The second interrupt may be different from the first interrupt.

At least one other example embodiment provides a system-on-chip (SoC) device comprising: a display controller configured to receive a trigger signal including n number of pulses per second, where n is a natural number, and to output image data based on the received trigger signal; and a transceiver configured to receive an interrupt. In a first mode, the display controller is configured to output the image data n times per second based on the trigger signal. In a second mode, which is different from the first mode, the display controller is configured to output the image data m times per second based on the trigger signal and the received interrupt, and m is a natural number smaller than n.

According to at least some example embodiments, the transceiver may be further configured to receive the interrupt m times per second, and m may be determined according to the image data.

In the first mode, the image data may include first image data and second image data, wherein the first image data is different from the second image data. In the second mode, the image data may include third image data and fourth image data, wherein the third image data and the fourth image data may be the same.

At least one other example embodiment provides a display driver comprising: a driver configured to generate an image signal based on received image data, and to output the generated image signal; and an image analyzer configured. The image analyzer is configured to: determine a frame rate for the image signal based on the image data; generate an interrupt based on the determined frame rate; and output the generated interrupt, the generated interrupt being indicative of a timing for receiving the image data at the driver.

According to at least some example embodiments, the driver may be further configured to output the generated image signal to a display panel, and the display panel may include a gallium-indium-zinc-oxide (GIZO) panel.

The display driver may further include a counter to determine an output timing for the generated interrupt.

The display driver may be further configured to output a trigger signal having a plurality of pulses. When the image data is in synchronization with a first of the plurality of pulses, rather than with a second of the plurality of pulses adjacent to the first of the plurality of pulses, the image analyzer may be configured to analyze the image data in synchronization with the first of the plurality of pulses to determine the frame rate for the image signal to be output to the display panel.

The display driver may further include a frame buffer configured to store the received image data. When the image data stored in the frame buffer is not updated at a first timing, the image analyzer may be configured to analyze the image data stored in the frame buffer to determine the frame rate for the image signal to be output to the display panel.

The image data may include still image data.

At least one other example embodiment provides a system-on-chip (SoC) system comprising: a display driver configured to generate an image signal based on image data, and to output the image signal; and a system-on-chip (SoC) device configured to supply the image data to the display driver based on a trigger signal from the display driver. When the image data is first image data, the SoC device is configured to supply the image data to the display driver in response to the trigger signal. When the image data is second image data, which is different from the first image data, the SoC device is configured to: receive an interrupt from the display driver; and output the image data to the display driver in response to the trigger signal and the received interrupt.

The first image data may include moving image data, and the second image data may include still image data.

The display driver may include an image analyzer configured to: analyze the second image data to determine a frame rate for the image signal; generate the interrupt based on the determined frame rate; and output the generated interrupt to the SoC device.

The trigger signal may include a plurality of pulses, and when the image data is in synchronization with a first of the plurality of pulses, rather than with a second of the plurality of pulses adjacent to the first of the plurality of pulses, the image analyzer may be configured to analyze the image data in synchronization with the first of the plurality of pulses to determine the frame rate for the image signal.

At least one other example embodiment provides a system-on-chip (SoC) device comprising a display controller configured to: in the first mode, output image data in synchronization with a plurality of pulses of a received trigger signal; in a second mode, output image data in synchronization with a pulse of the received trigger signal only after receiving a first interrupt signal; and switch from the first mode to the second mode in response to outputting a same image data in synchronization with a threshold number of consecutive pulses of the received trigger signal.

The SoC device may further include an interrupt controller configured to output a second interrupt signal to the display controller in response to an event. The display controller may be further configured to switch from the second mode to the first mode in response to the second interrupt signal. The image data output in the first mode may be moving image data, and the image data output in the second mode may be still image data.

In the first mode, the display controller may be configured to output the image data in synchronization with each of the plurality of pulses of the received trigger signal.

In the second mode, the display controller may be configured to: receive the first interrupt signal during a first time period; and output the image data in synchronization with only a pulse of the trigger signal received during a second time period, the second time period being adjacent to the first time period. The threshold number of consecutive pulses may be greater than or equal to 2.

In the first mode, the display controller may be configured to output the image data at a first frequency, the first frequency corresponding to a frequency of the trigger signal. In the second mode, the display controller may be configured to output the image data at a second frequency, the second frequency being less than the frequency of the trigger signal.

BRIEF DESCRIPTION OF THE DRAWINGS

Example embodiments of inventive concepts will become more apparent by describing in detail the example embodiments shown in the attached drawings in which.

DETAILED DESCRIPTION

Figure 1:
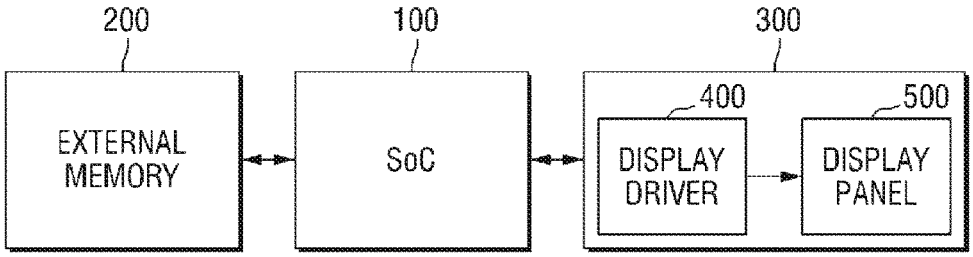
FIG. 1 is a block diagram of a system on chip (SoC) system according to an example embodiment of inventive concepts.

Inventive concepts will become more readily understood by reference to the following detailed description of example embodiments and the accompanying drawings. Inventive concepts may, however, be embodied in many different forms and should not be construed as being limited to the example embodiments set forth herein. Rather, these example embodiments are provided so that this disclosure will be thorough and complete and will fully convey concept of the inventive concepts to those skilled in the art, and the inventive concepts will only be defined by the appended claims. Like reference numerals refer to like elements throughout the specification.

The terminology used herein is for the purpose of describing particular embodiments only and is not intended to be limiting of inventive concepts. As used herein, the singular forms "a", "an" and "the" are intended to include the plural forms as well, unless the context clearly indicates otherwise. It will be further understood that the terms "comprises," "comprising," "includes," and/or "including," when used in this specification, specify the presence of stated features, integers, steps, operations, elements, and/or components, but do not preclude the presence or addition of one or more other features, integers, steps, operations, elements, components, and/or groups thereof.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on", "directly connected to" or "directly coupled to" another element or layer, there are no intervening elements or layers present. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of inventive concepts.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Example embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, these example embodiments should not be construed as limited to the particular shapes of regions illustrated herein, but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of inventive concepts.

Unless otherwise defined, all terms (including technical and scientific terms) used herein have the same meaning as commonly understood by one of ordinary skill in the art to which the present inventive concept belongs. It will be further understood that terms, such as those defined in commonly used dictionaries, should be interpreted as having a meaning that is consistent with their meaning in the context of the relevant art and this specification and will not be interpreted in an idealized or overly formal sense unless expressly so defined herein.

Unless specifically stated otherwise, or as is apparent from the discussion, terms such as "processing" or "computing" or "calculating" or "determining" or "displaying" or the like, refer to the action and processes of a computer system, or similar electronic computing device, that manipulates and transforms data represented as physical, electronic quantities within the computer system's registers and memories into other data similarly represented as physical quantities within the computer system memories or registers or other such information storage, transmission or display devices.

Specific details are provided in the following description to provide a thorough understanding of example embodiments. However, it will be understood by one of ordinary skill in the art that example embodiments may be practiced without these specific details. For example, systems may be shown in block diagrams so as not to obscure the example embodiments in unnecessary detail. In other instances, well-known processes, structures and techniques may be shown without unnecessary detail in order to avoid obscuring example embodiments.

In the following description, illustrative embodiments may be described with reference to acts and symbolic representations of operations (e.g., in the form of flow charts, flow diagrams, data flow diagrams, structure diagrams, block diagrams, etc.) that may be implemented as program modules or functional processes including routines, programs, objects, components, data structures, etc., that perform particular tasks or implement particular abstract data types. The operations be implemented using existing hardware in existing electronic systems (e.g., display drivers, System-on-Chip (SoC) devices, SoC systems, electronic devices, such as personal digital assistants (PDAs), smartphones, tablet personal computers (PCs), laptop computers, etc.). Such existing hardware may include one or more Central Processing Units (CPUs), digital signal processors (DSPs), application-specific-integrated-circuits (ASICs), SoCs, field programmable gate arrays (FPGAs), computers, or the like.

Further, one or more example embodiments may be (or include) hardware, firmware, hardware executing software, or any combination thereof. Such hardware may include one or more CPUs, SoCs, DSPs, ASICs, FPGAs, computers, or the like, configured as special purpose machines to perform the functions described herein as well as any other well-known functions of these elements. In at least some cases, CPUs, SoCs, DSPs, ASICs and FPGAs may generally be referred to as processing circuits, processors and/or microprocessors.

Although a flow chart may describe operations as a sequential process, many of the operations may be performed in parallel, concurrently or simultaneously. In addition, the order of the operations may be re-arranged. A process may be terminated when its operations are completed, but may also have additional steps not included in the figure. A process may correspond to a method, function, procedure, subroutine, subprogram, etc. When a process corresponds to a function, its termination may correspond to a return of the function to the calling function or the main function.

As disclosed herein, the term "storage medium", "computer readable storage medium" or "non-transitory computer readable storage medium," may represent one or more devices for storing data, including read only memory (ROM), random access memory (RAM), magnetic RAM, core memory, magnetic disk storage mediums, optical storage mediums, flash memory devices and/or other tangible machine readable mediums for storing information. The term "computer-readable medium" may include, but is not limited to, portable or fixed storage devices, optical storage devices, and various other mediums capable of storing, containing or carrying instruction(s) and/or data.

Furthermore, at least some portions of example embodiments may be implemented by hardware, software, firmware, middleware, microcode, hardware description languages, or any combination thereof. When implemented in software, firmware, middleware or microcode, the program code or code segments to perform the necessary tasks may be stored in a machine or computer readable medium such as a computer readable storage medium. When implemented in software, processor(s), processing circuit(s), or processing unit(s) may be programmed to perform the necessary tasks, thereby being transformed into special purpose processor(s) or computer(s).

A code segment may represent a procedure, function, subprogram, program, routine, subroutine, module, software package, class, or any combination of instructions, data structures or program statements. A code segment may be coupled to another code segment or a hardware circuit by passing and/or receiving information, data, arguments, parameters or memory contents. Information, arguments, parameters, data, etc. may be passed, forwarded, or transmitted via any suitable means including memory sharing, message passing, token passing, network transmission, etc.

Hereinafter, example embodiments of system-on-chip (SoC) systems will be described with reference to FIGS. 1 to 3.

FIG. 1 is a block diagram of a system on chip (SoC) system according to an example embodiment of inventive concepts.

Referring to FIG. 1, the SoC system includes a SoC device 100, an external memory 200 and a display device 300.

In at least some example embodiments of inventive concepts, the SoC device 100, the external memory 200 and the display device 300 may be implemented as discrete chips, respectively. In addition, in at least some example embodiments of inventive concepts, the SoC system may further include other components (e.g., a camera module, a network device, etc.), although not shown.

In addition, in one or more example embodiments of inventive concepts, the SoC system may be incorporated into an electronic device capable of outputting a still picture signal (or a still image) or a motion picture signal (or a moving image) to a display panel 500.

The external memory 200 may store program instructions executed in the SoC device 100.

In addition, in one or more example embodiments of inventive concepts, the external memory 200 may store image data for images to be output to the display device 300.

In at least this example embodiment, the image data may include moving image data and still image data. Here, the moving image data may be, for example, a combination of series of different still image data presented in a relatively short time.

In other words, in at least this example embodiment, the moving image data may include dynamic image data and the still image data may include static image data.

However, inventive concepts are not limited to the example embodiments discussed herein. In at least some cases, the external memory 200 may not be provided. For example, since the SoC device 100 according to at least this example embodiment of inventive concepts outputs image data "on the fly," the image data may not be stored in the external memory 200, so that the external memory 200 is not necessarily provided.

In at least some example embodiments of inventive concepts, the external memory 200 may include a volatile memory or a non-volatile memory.

Examples of the volatile memory may include a dynamic random access memory (DRAM), a static random access memory (SRAM), a thyristor RAM (T-RAM), a zero capacitor RAM (Z-RAM), or a twin transistor RAM (TTRAM), but example embodiments of inventive concepts are not limited thereto.

Meanwhile, examples of the non-volatile memory may include an electrically erasable programmable read-only memory (EEPROM), a flash memory, magnetic RAM (MRAM), a phase change RAM (PRAM), a resistive memory, and so on, but example embodiments of inventive concepts are not limited thereto.

The SoC device 100 may control the external memory 200 and/or the display device 300.

In at least some example embodiments of inventive concepts, the SoC device 100 may also be referred to as an integrated circuit (IC), a processor, an application processor, a multimedia processor, or an integrated multimedia processor.

The display device 300 may include a display driver 400 and a display panel 500.

In at least some example embodiments of inventive concepts, the SoC device 100 and the display driver 400 may be implemented as a module, a system on chip, or a package, for example, multi-chip package.

In some other example embodiments of inventive concepts, the display driver 400 and the display panel 500 may be implemented as a single module.

In addition, in at least some example embodiments of inventive concepts, the external memory 200, the SoC device 100 and the display device 300 may be incorporated into a single electronic device to be implemented.

The display driver 400 may control the operation of the display panel 500 according to signals output from the SoC device 100. For example, the display driver 400 may convert the image data received from the SoC device 100 into an image signal and may transmit the image signal to the display panel 500 through a selected interface.

The display panel 500 may output a moving image or a still image based on the image signal received from the display driver 400. For example, the display panel 500 may include a liquid crystal display (LCD) panel, a light emitting diode (LED) display panel, an organic LED) (OLED) display panel, or an active-matrix OLED (AMOLED) display panel, and so on.

Figure 2:
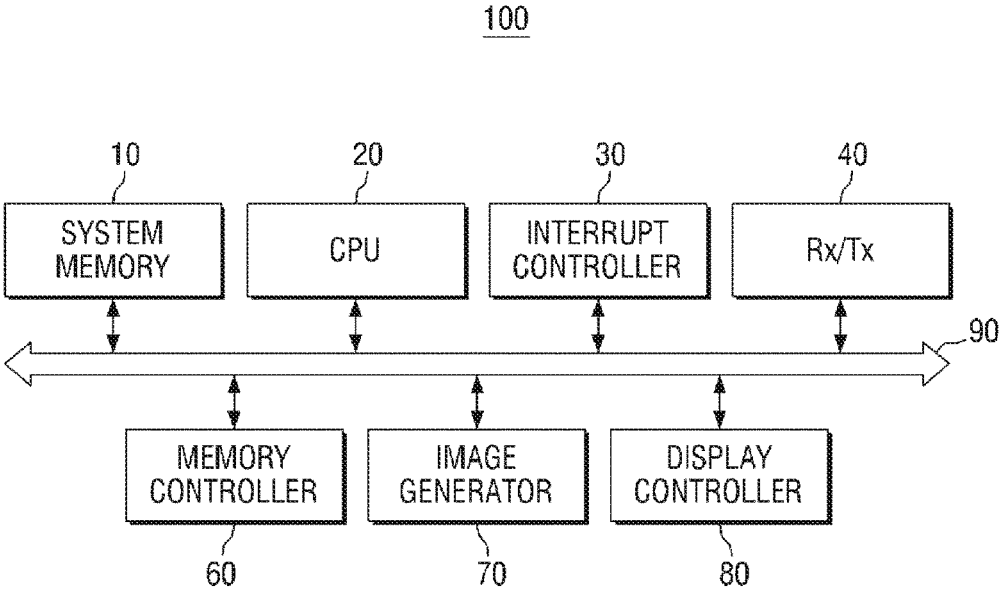
FIG. 2 is a block diagram of an example embodiment of the SoC device shown in FIG. 1.

FIG. 2 is a block diagram of an example embodiment of the SoC device shown in FIG. 1.

Referring to FIG. 2, the SoC device 100 may include a system memory 10, a central processing unit (CPU) 20, an interrupt controller 30, a receiver/transmitter (Rx/Tx) 40, a memory controller 60, an image generator 70, and a display controller 80. As discussed herein, a receiver/transmitter (Rx/Tx) may also be referred to as a transceiver.

The system memory 10 may store instructions, parameters, etc. required for the operation of the SoC device 100. For example, the CPU 20 may operate using the instructions, parameters, etc., stored in the system memory 10.

The CPU 20 may control the overall operation of the SoC device 100. For example, the CPU 20 may control operations of the components 10, 30, 40, 60, 70 and 80.

In at least some example embodiments of inventive concepts, the CPU 20 may make a request to the image generator 70 to generate or process an image.

In addition, in at least some example embodiments of inventive concepts, the CPU 20 controls the display controller 80 to supply the image data to the display driver 400 when a wakeup interrupt (W_I of FIG. 7) is received from the display driver (400 of FIG. 1) through the Rx/Tx 40.

In at least some example embodiments of inventive concepts, the CPU 20 may be implemented as a multi-core processor. The multi-core processor may include two or more independent cores.

The two or more independent cores may have the same or substantially the same processing performance, or may be differently implemented when necessary.

The interrupt controller 30 may control interrupts generated during the operation of the SoC device 100.

The interrupt controller 30 may receive interrupts from the respective components, may adjust execution sequences of the respective interrupts, and may transfer the adjusted execution sequences to the CPU 20 to perform operations corresponding to the interrupts.

In at least some example embodiments of inventive concepts, when a wakeup interrupt (W_I of FIG. 7) is received through the Rx/Tx 40, the interrupt controller 30 may generate an internal interrupt associated with the wakeup interrupt, and may transfer the generated internal interrupt to the CPU 20.

In addition, in at least some example embodiments of inventive concepts, the interrupt controller 30 may generate an exit interrupt (E_I of FIG. 9) under the control of the CPU 20, and may supply the same to the display controller 80 and the display driver (400 of FIG. 1).

The Rx/Tx 40 may receive/transmit the instructions, signals, interrupts or data converted according to various interface specifications from/to the display device (300 of FIG. 1).

In at least some example embodiments of inventive concepts, the Rx/Tx 40 may receive the wakeup interrupt (W_I of FIG. 7) from the display driver (400 of FIG. 1) and may transmit an exit interrupt (E_I of FIG. 9) to the display driver (400 of FIG. 1).

In addition, in at least some example embodiments of inventive concepts, the Rx/Tx 40 may supply the image data stored in the external memory (200 of FIG. 1) to the display driver (400 of FIG. 1).

The memory controller 60 may control the operation of a memory device when receiving/transmitting data from/to the external memory (200 of FIG. 1) connected to the SoC device 100. That is, for example, the memory controller 60 may access the external memory (200 of FIG. 1) in response to a request from the CPU 20, the image generator 70 or the display controller 80 and may read, write or erase the image data.

The image generator 70 may read program instructions associated with graphic processing, and may execute the program instructions. In at least some example embodiments of inventive concepts, the image generator 70 may be implemented as a graphics engine, a graphics processing unit (GPU), or a graphics card. The image generator 70 may generate or process an image under the control of the CPU 20.

The display controller 80 may control the operation of the SoC device 100 with respect to the display device (300 of FIG. 1), or may control the operation of the display device (300 of FIG. 1) with respect to the SoC device 100.

In at least some example embodiments of inventive concepts, the display controller 80 may control the memory controller 60 to output the data stored in the external memory (200 of FIG. 1) through the Rx/Tx 40.

In at least some example embodiments of inventive concepts, the display controller 80 may control the image generator 70 to output the image data generated by the image generator 70 through the Rx/Tx 40.

Figure 4:
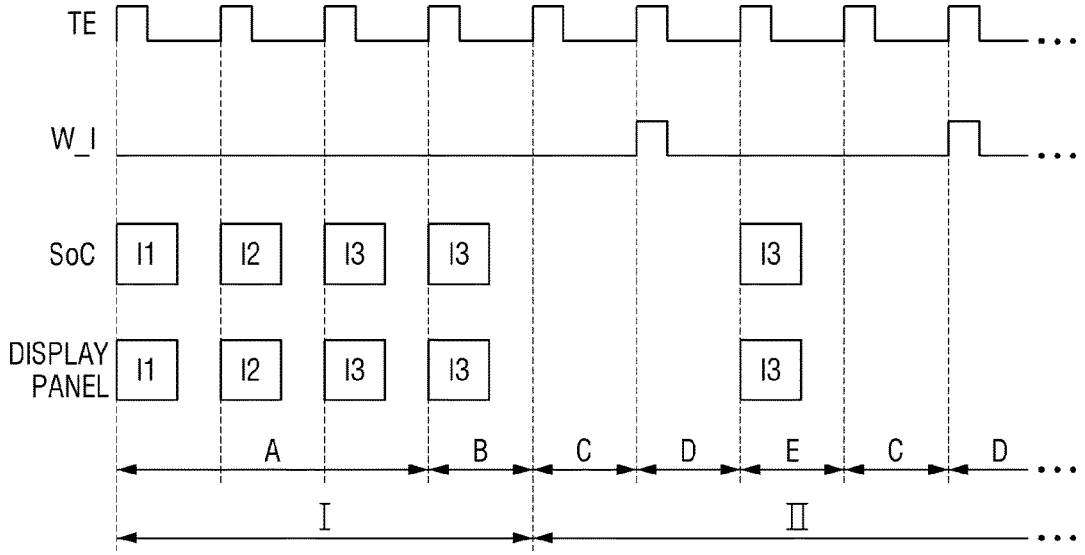
FIGS. 4 to 10 are diagrams illustrating example operation of the example embodiment of the SoC system shown in FIG. 1.

The display controller 80 may control the memory controller 60 or the image generator 70 to supply moving image data from the SoC device 100 to the display controller 400 in a first mode (I of FIG. 4), and to supply still image data from the SoC device 100 to the display controller 400 in a second mode (II of FIG. 4).

In addition, in at least some example embodiments of inventive concepts, the display controller 80 may control the memory controller 60 or the image generator 70 to supply image data n times per second (n is a natural number) from the SoC device 100 to the display controller 400 in the first mode (I of FIG. 4), and to supply image data m times per second (m is a natural number smaller than n) from the SoC device 100 to the display controller 400 in the second mode (II of FIG. 4).

A system bus 90 may connect the respective components of the SoC device 100 to each other, and may serve as a path for data reception/transmission between each of the respective components. In at least some example embodiments of inventive concepts, the system bus 90 may include a relatively small-scale bus established for data communication between each of the respective components.

Figure 3:
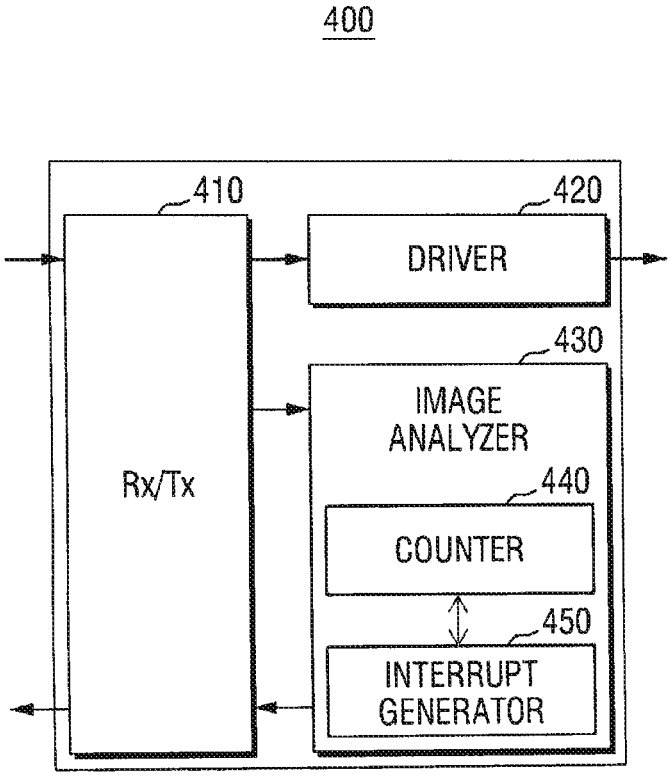
FIG. 3 is a block diagram of an example embodiment of the display driver shown in FIG. 1.

FIG. 3 is a block diagram of an example embodiment of the display driver show in FIG. 1.

Referring to FIG. 3, the display driver 400 may include a receiver/transmitter (Rx/Tx) 410, a driver 420, and an image analyzer 430.

The Rx/Tx 410 may receive/transmit the instructions, signals, interrupts or data converted according to various interface specifications from/to the SoC device (100 of FIG. 1).

The driver 420 may receive image data through the Rx/Tx 410 and may generate an image signal based on the received image data. In more detail, for example, the driver 420 may generate the image signal corresponding to the received image data. In addition, the driver 420 may output the generated image signal to the display panel (500 of FIG. 1). The display panel (500 of FIG. 1) may be driven by the received image signal to output an image.

In at least some example embodiments of inventive concepts, the display panel (500 of FIG. 1) may include an oxide semiconductor panel. In more detail, for example, display panel (500 of FIG. 1) may include an gallium indium zinc oxide (GIZO) panel. In at least this example, if the display panel (500 of FIG. 1) includes an GIZO panel, a decrease in image quality may be suppressed and/or prevented even if a frame rate of an image output to the panel is reduced.

In at least some example embodiments of inventive concepts, driver 420 may include a gate driver and a source driver, but inventive concepts are not limited thereto.

The image analyzer 430 may analyze, for example, the still image data received through the Rx/Tx 410, to determine a frame rate of an image to be output to the display panel (500 of FIG. 1), and may generate an interrupt based on the determined frame rate to be output to the SoC device (100 of FIG. 1).

In at least some example embodiments of inventive concepts, the interrupt generated by the image analyzer 430 and output to the SoC device (100 of FIG. 1) may be a wakeup interrupt (W_I of FIG. 7) making a request to the SoC device (100 of FIG. 1) to supply image data for the purpose of suppressing and/or preventing deterioration in quality of the image output to the display panel (500 of FIG. 1), which will be described in more detail later.

In at least some example embodiments of inventive concepts, to generate interrupts the image analyzer 430 may include a counter 440 and an interrupt generator 450.

The counter 440 may be used in determining an output timing (output point of timing) of the interrupt. In more detail, for example, the counter 440 may perform a counting operation for each pulse of a trigger signal TE after a given (or alternatively, desired or predetermined) control signal is applied from the image analyzer 430, and may be configured to output the control signal to instruct the interrupt generator 450 to generate the interrupt if a target count value set by the image analyzer 430 is reached.

The interrupt generator 450 may receive the control signal from the counter 440, may generate the interrupt (e.g., the wakeup interrupt (W_I of FIG. 7)), and may output the generated interrupt to the SoC device (100 of FIG. 1) through the Rx/Tx 410.

For the sake of convenient explanation, the counter 440 and the interrupt generator 450 are separately illustrated, but inventive concepts are not limited thereto.

In at least some example embodiments of inventive concepts, the counter 440 and the interrupt generator 450 may be completely integrated into the image analyzer 430 and functions thereof may then be implemented.

In addition, in at least some other example embodiments of inventive concepts, the image analyzer 430, the counter 440 and the interrupt generator 450 may be completely separate from one another, and functions thereof may be separately implemented.

In addition, in at least some other example embodiments of inventive concepts, if the interrupt generator 450 is not provided and a counting operation of the counter 440 is completed, inventive concepts may be modified and implemented such that the image analyzer 430 generates and outputs the interrupt.

Hereinafter, an operation of the SoC system shown in FIG. 1 will be described with reference to FIGS. 4 to 10.

FIGS. 4 to 10 are diagrams illustrating an example operation method of the example embodiment of the SoC system shown in FIG. 1.

Hereinafter, the operation of the SoC system according to one or more example embodiments of inventive concepts will be described with regard to a command mode by way of example. That is, for example, the operation of the SoC system will be described in an operating mode in which the SoC device (100 of FIG. 1) supplies image data to the display driver (400 of FIG. 1). In this example, the image data is supplied in synchronization with a trigger signal TE received from the display driver (400 of FIG. 1), but inventive concepts are not limited thereto.

Figure 5:
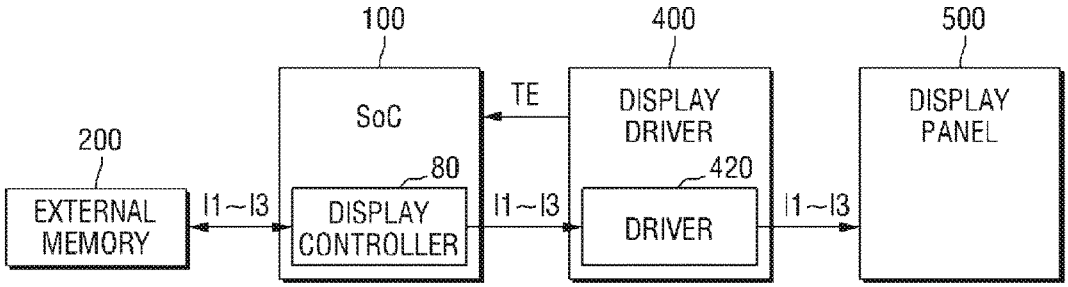

First, referring to FIGS. 4 and 5, the SoC device 100 according to example embodiments may operate in the first mode I until the same image data is consecutively output to the display driver 400 p number of times (p is a natural number of 2 or greater.).

If the same image data is consecutively output to the display driver 400 p times, then the SoC device 100 may determine that a still image (no updated image) needs to be output to the display panel 500, and may operate in the second mode II.

In at least some example embodiments of inventive concepts, the first mode I may be, for example, a motion picture play mode in which different images should be consecutively output to the display panel 500, and the second mode II may be, for example, a still picture play mode in which the same image should be consecutively output to the display panel 500.

For the sake of convenience, the operation of the SoC device 100 will now be described separately in the first mode I and the second mode II. However, in the actual operation of the SoC device 100, the first mode I and the second mode II may not be clearly distinguished from each other.

That is, for example, when the SoC device 100 operates to output an image to the display panel 500, the first mode I and the second mode II may be consecutively repeated.

In the illustrated example embodiment, when the SoC device 100 consecutively outputs the same image data to the display driver 400 p times, where p is a natural number greater than or equal to 2, an operating mode of the display driver 400 is switched from the first mode I to the second mode II, but inventive concepts are not limited thereto. That is, for example, conditions under which the operating mode of the display driver 400 is switched from a motion picture play mode to a still picture play mode may vary in many ways.

In the following description, the operation of the SoC system according to an example embodiment of inventive concepts will be described with regard to a case where the operating mode is switched to the second mode II when the SoC device 100 consecutively outputs the same image data to the display driver 400 twice (p=2), but inventive concepts are not limited thereto.

Referring again to FIGS. 4 and 5, in period A the SoC device 100 may receive a trigger signal TE from the display driver 400, and may output the image data I1 to I3, which are different from one another, in synchronization with the trigger signal TE.

In at least some example embodiments of inventive concepts, the trigger signal TE may have a frequency of, for example, about 60 Hz. That is, the trigger signal TE may have pulses applied about 60 times per second, but inventive concepts are not limited thereto. The frequency of the trigger signal TE may vary.

In period A, for example, the display controller 80 of the SoC device 100 may control the memory controller (60 of FIG. 2) to output the image data I1 to I3 stored in the external memory 200 in synchronization with a pulse of the trigger signal TE.

In addition, in at least some other example embodiments of inventive concepts, the display controller 80 of the SoC device 100 may control the image generator (70 of FIG. 2) to output the image data I1 to I3 in synchronization with a pulse of the trigger signal TE.

The image data I1 to I3 supplied from the SoC device 100 to the display driver 400 in the period A may include moving image data.

That is, for example, the image data I1 to I3 supplied from the SoC device 100 to the display driver 400 in period A are image data I1 to I3 for playing motion pictures, which may be different from one another.

If the trigger signal TE has pulses applied n times per seconds (n is a natural number), then the SoC device 100 may output image data I1 to I3, which are different from one another, in period A, n times per second.

The different image data I1 to I3 supplied to the display driver 400 may be generated as given (or alternatively, desired or predetermined) image signals to then be supplied to the display panel 500. Accordingly, images based on the different image data I1 to I3 may be output to the display panel 500.

Next, referring to FIG. 4, in period B, since the same image data I3 is output from the SoC device 100 to the display driver 400 twice, the operating mode of the display controller 80 of the SoC device 100 may be switched from the first mode I to the second mode II.

In a case where the image analyzer 430 determines to output the image data I3 to the display panel 500 with an image of about 20 frames per second, the display driver 400 may receive the image data I3 from the SoC device 100 about 20 times per second. Therefore, the image analyzer 430 may supply the wakeup interrupt W_I to the SoC device 100 about 20 times per second.

Accordingly, if the trigger signal TE has pulses applied about n times per second (n is a natural number), the SoC device 100 may output the same image data (e.g., I3) about m times per second (m is a natural number smaller than n) in the second mode II.

In the second mode II, no image data may be output from the SoC device 100 until the wakeup interrupt W_I is received from the display driver 400, and after the wakeup interrupt W_I is received from the display driver 400, the SoC device 100 may output image data (e.g., I3) in synchronization with a next pulse included in the trigger signal TE.

In such a manner, the image data from the SoC device 100 to the display driver 400 may include, for example, still image data.

A timing at which the wakeup interrupt W_I is output from the display driver 400 may be determined by the image analyzer 430 of the display driver 400.

In more detail, for example, the image analyzer 430 may analyze the receive image data (e.g., I3) to determine a frame rate of an image to be output to the display panel 500, may generate the wakeup interrupt W_I based on the determined frame rate, and may then output the generated wakeup interrupt W_I.

As the analysis result of the image analyzer 430, the following description will be made on the assumption that there will be no deterioration in the still image quality when the image data I3 is analyzed to output 20 frames per second to the display panel 500.

Figure 6:
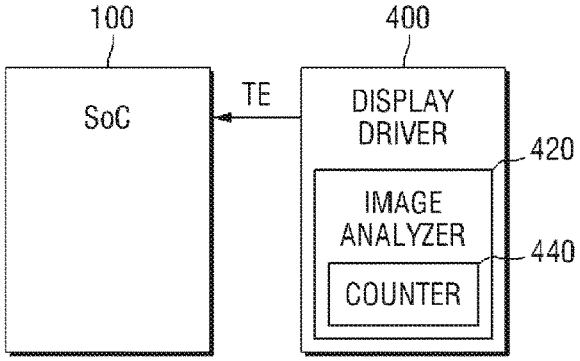

Referring to FIGS. 4 and 6, in period C in which the wakeup interrupt W_I has yet to be received from the display driver 400, the SoC device 100 may not output the image data (e.g., I3).

In more detail, for example, the display controller 80 of the SoC device 100 may control the memory controller (60 of FIG. 2) not to output the image data (e.g., I3) stored in the external memory 200 in synchronization with the pulse of the trigger signal TE.

In addition, in at least some other example embodiments of inventive concepts, the display controller 80 of the SoC device 100 may control the image generator (70 of FIG. 2) not to output the image data (e.g., I3) in synchronization with the pulse of the trigger signal TE.

Since the image data (e.g., I3) has not yet been supplied to the display driver 400, an image corresponding to the image data (e.g., I3) may not be output to the display panel 500, either.

Meanwhile, in period C, the image analyzer 430 may apply a given (or alternatively, desired or predetermined) control signal to the counter 440 to instruct the counter 440 to start a counting operation, and may monitor count values of the counter 440.

Figure 7:
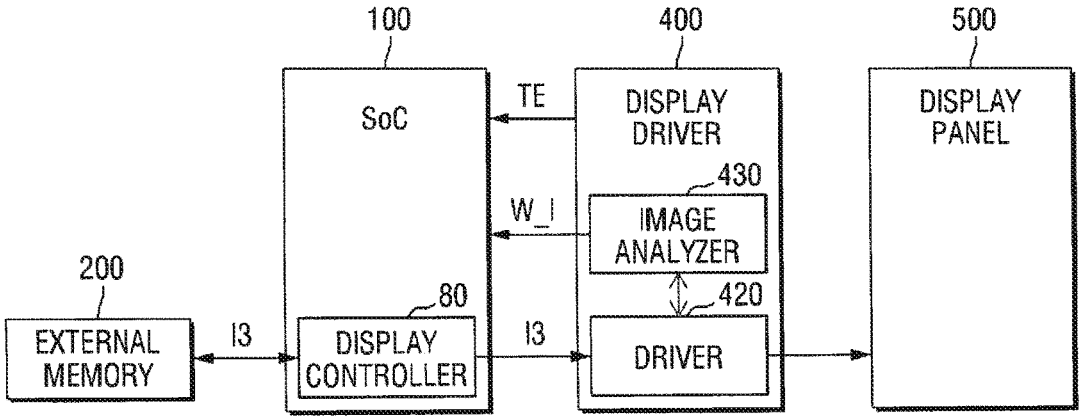

Next, referring to FIGS. 4 and 7, in period D, if the count value of the counter 440 reaches a value obtained by analyzing the image data I3, then the image analyzer 430 supplies the wakeup interrupt W_I to the SoC device 100.

In at least some example embodiments of inventive concepts, as shown, the wakeup interrupt W_I is supplied to the SoC device 100 in synchronization with the pulse of the trigger signal TE.

After receiving the wakeup interrupt W_I, the interrupt controller (30 of FIG. 2) of the SoC device 100 may control the display controller 80 to get ready to output the image data through the CPU (20 of FIG. 2).

Referring again to FIGS. 4 and 7, in period E, for example, the display controller 80 of the SoC device 100 may control the memory controller (60 of FIG. 2) to output the image data (e.g., I3) stored in the external memory 200 in synchronization with a pulse of the trigger signal TE.

In addition, in at least some other example embodiments of inventive concepts, display controller 80 of the SoC device 100 may control the image generator (70 of FIG. 2) to output the image data (e.g., I3) in synchronization with a pulse of the trigger signal TE.

Accordingly, as the image data I3 is supplied from the SoC device 100 to the driver 420 of the display driver 400, the driver 420 may generate an image signal based on the image data I3 and may then output the generated image signal to the display panel 500. Therefore, an image corresponding to the image data I3 may be output to the display panel 500.

As shown in FIG. 4, in at least some example embodiments of inventive concepts, a pulse of the trigger signal TE supplying the wakeup interrupt W_I from the display driver 400 to the SoC device 100, and a pulse of the trigger signal TE supplying the image data (e.g., I3) from the SoC device 100 to the display driver 400, may be different from each other.

That is, for example, when the wakeup interrupt W_I is received in the Rx/Tx 40 in synchronization with a first pulse included in the trigger signal TE, the display controller 80 may output the image data (e.g., I3) to the display driver 400 in synchronization with a second pulse different from the first pulse.

Thereafter, the SoC system may repeatedly operate from period C to period E until reaching a timing at which a moving image is to be output to the display panel 500.

Figure 8:
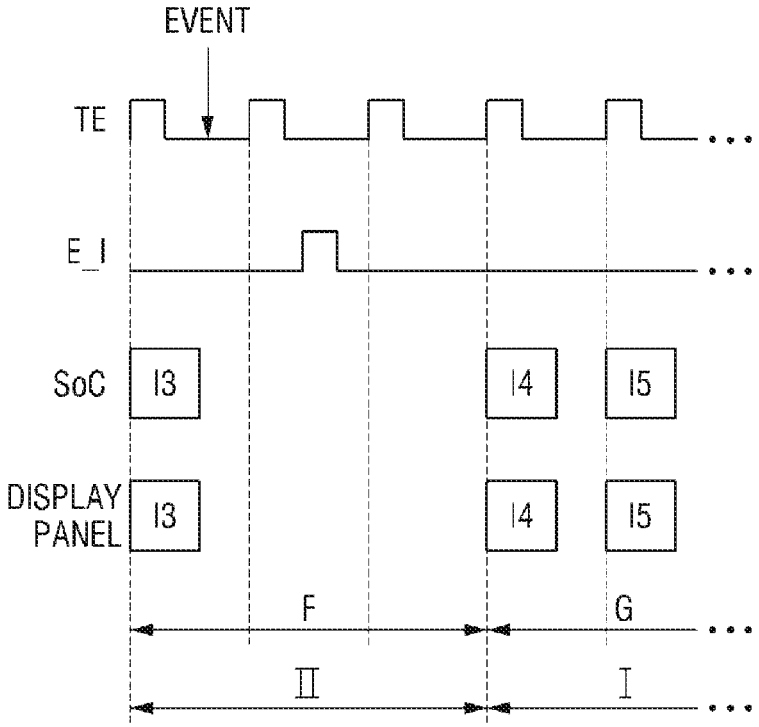
Figure 9:
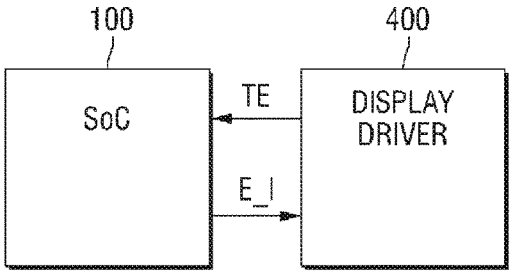

Next, referring to FIGS. 8 and 9, in period F, if an event that the display controller 80 should be switched to a motion picture play mode (first mode I), such as a panel touch by a user, is generated, the interrupt controller 30 of the SoC device 100 may generate an exit interrupt E_I under the control of the CPU 20, and may supply the generated exit interrupt E_I to the display controller 80. In addition, the interrupt controller 30 may supply the generated exit interrupt E_I to the display driver 400 through the Rx/Tx 40.

After receiving the exit interrupt E_I, the display driver 400 may prepare to drive the driver 420 using the moving image data supplied from the SoC device 100.

In addition, after receiving the exit interrupt E_I, the display controller 80 may prepare to transmit moving image data to the display driver 400 in synchronization with the trigger signal TE. That is, for example, the display controller 80 may prepare to switch from the second mode II to the first mode I.

Figure 10:
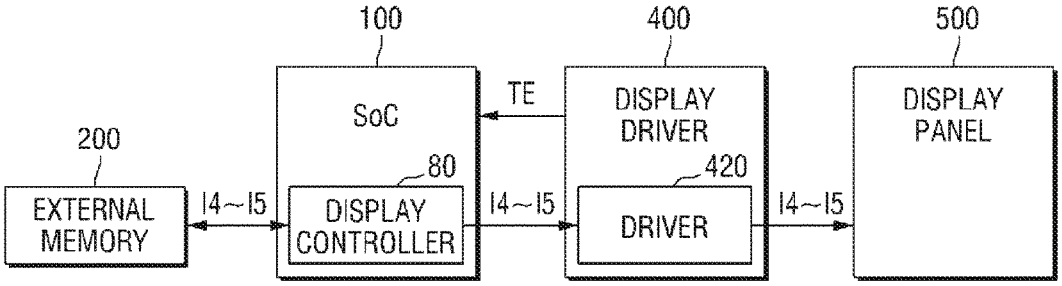

Next, referring to FIGS. 8 and 10, in period G, if the image data to be supplied from the SoC device 100 to the display driver 400 is changed (e.g., from image data I3 to image data I4), then the display controller 80 of the SoC device 100 may control the memory controller 60 to output the image data (e.g., I4) stored in the external memory (200 of FIG. 1) through the Rx/Tx 40 in synchronization with the trigger signal TE.

In addition, in at least some other example embodiments of inventive concepts, the display controller 80 may control the image generator 70 to output the image data (e.g., I4) generated by the image generator 70 through the Rx/Tx 40 in synchronization with the trigger signal TE.

That is, for example, the display controller 80 may control the memory controller 60 or the image generator 70 to supply the moving image data (e.g., I4, I5) from the SoC device 100 to the display controller 400 in the first mode I.

Accordingly, in a case where the trigger signal TE has pulses applied about n times per second, the image data (e.g., I3) is supplied from the SoC device 100 to the display controller 400 about m times per second (m is a natural number smaller than n) in the second mode II, while image data (e.g., I4 and I5) are supplied about n times per second in the first mode I.

The image data I4 and I5 supplied to the display driver 400 may be generated as image signals through the driver 420 to then be supplied to the display panel 500. The image data I4 and I5 are different from each other. Accordingly, images corresponding to the different image data I4 and I5 may be output to the display panel 500.

As described above, in the SoC system according to at least this example embodiment, in a case where a still image based on the still image data needs to be output to the display panel 500, the still image data is analyzed to determine a frame rate of an image to suppress and/or prevent deterioration of quality of the image output to the display panel 500.

Then, a wakeup interrupt W_I is generated at a processing timing of image data according to the determined frame rate, thereby reducing (e.g., minimizing) throughput of the image data in the SoC device 100 and the display driver 400.

Accordingly, power consumption may be reduced in displaying the image on the display panel 500.

In addition, the SoC system according to at least this example embodiment may process moving image data in synchronization with the trigger signal TE in the first mode I, and process still image data using the wakeup interrupt W_I in the second mode II, so that a frame buffer in the display driver 400 is not necessarily provided and/or needed. Accordingly, size of the display driver 400 may be reduced.

A SoC system according to another example embodiment of inventive concepts will be described with reference to FIG. 11.

Figure 11:
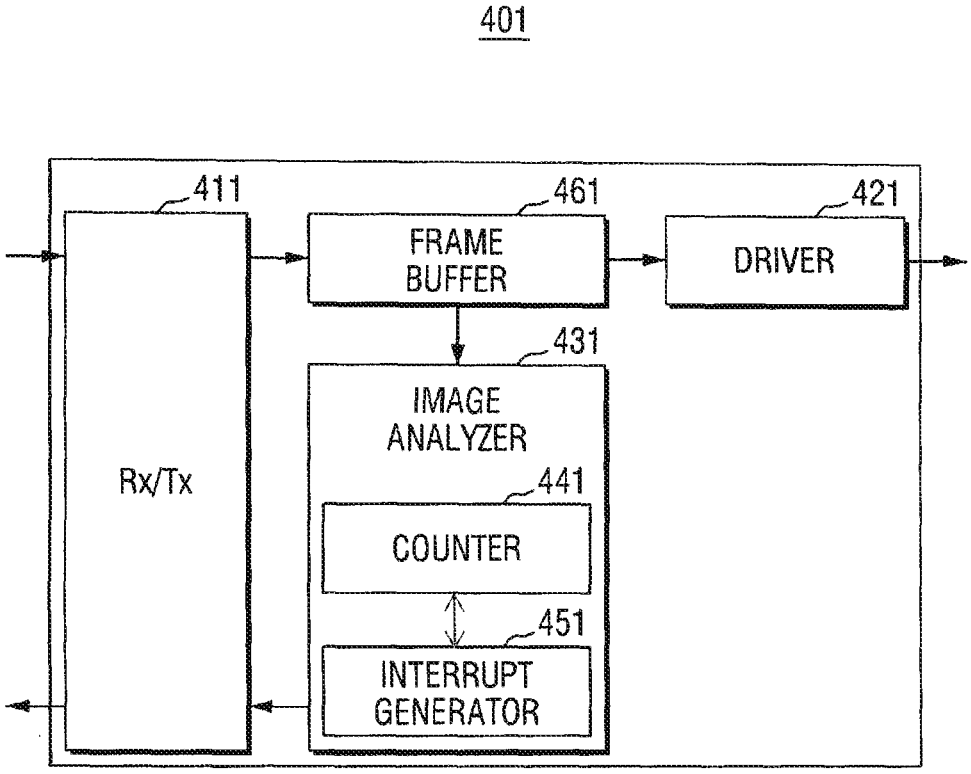
FIG. 11 is a block diagram of a display driver included in a SoC system, according to another example embodiment of inventive concepts.

FIG. 11 is a block diagram of a display driver included in a SoC system according to another example embodiment of inventive concepts.

Hereinafter, repeated descriptions with the example embodiment discussed above will not be given and the following description will focus on differences between this example embodiment and the example embodiment discussed previously.

Referring to FIG. 11, the display driver 401 included in the SoC system, according to another example embodiment of inventive concepts may include a receiver/transmitter (Rx/Tx) 411, a driver 421, an image analyzer 431, and a frame buffer 461.

The Rx/Tx 411 may receive transmit the instructions, signals, interrupts, and/or data converted according to various interface specifications, from/to the display device (300 of FIG. 1).

The driver 421 may receive image data stored in the frame buffer 461 through the Rx/Tx 411, and may generate an image signal based on the image data. In more detail, for example, the driver 421 may generate an image signal corresponding to the received image data. The driver 421 may output the generated image signal to the display panel (500 of FIG. 1). The display panel (500 of FIG. 1) may be driven by the received image signal to then output an image.

The image analyzer 431 may analyze, for example, still image data stored in the frame buffer 461 to determine a frame rate of an image to be output to the display panel (500 of FIG. 1), and may generate and output an interrupt (e.g., W_I of FIG. 4) based on the determined frame rate of the image.

In at least some example embodiments of inventive concepts, in order to generate the interrupts, the image analyzer 431 may include a counter 441 and an interrupt generator 451.

The frame buffer 461 may store image data supplied from the SoC device (100 of FIG. 1) through the Rx/Tx 411, and may supply the image data to the driver 421 to the image analyzer 431.

A SoC system according to still another example embodiment of inventive concepts will be described with reference to FIG. 12.

Figure 12:
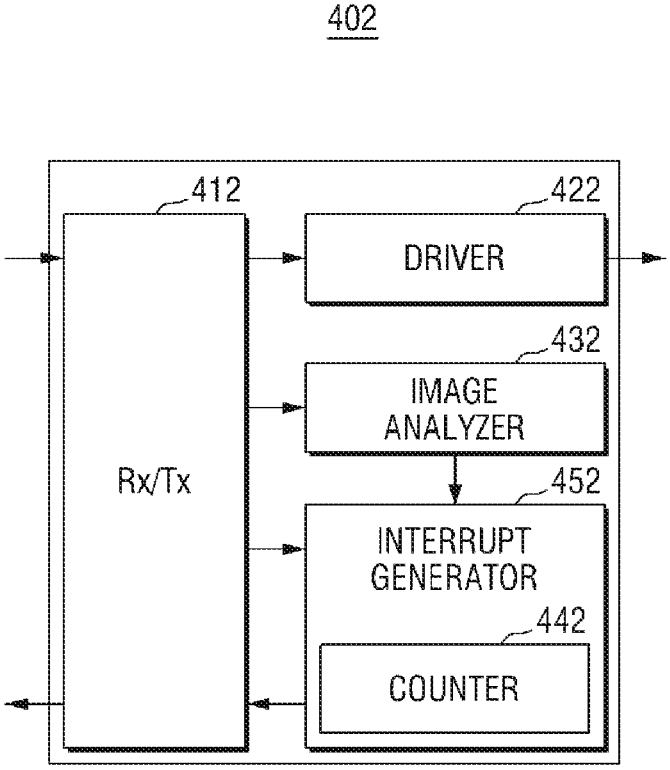
FIG. 12 is a block diagram of a display driver included in a SoC system, according to still another example embodiment of inventive concepts.

FIG. 12 is a block diagram of a display driver included in a SoC system, according to still another example embodiment of inventive concepts.

Hereinafter, repeated descriptions with the example embodiment discussed previously will not be given and the following description will focus on differences between this example embodiment and the example embodiment discussed previously.

Referring to FIG. 12, the display driver 402 included in the SoC system according to another example embodiment of inventive concepts may include a receiver/transmitter (Rx/Tx) 412, a driver 422, an image analyzer 432, and an interrupt generator 452.

The Rx/Tx 412 may receive/transmit the instructions, signals, interrupts, and/or data converted according to various interface specifications, from/to the display device (300 of FIG. 1).

The driver 422 may receive image data supplied through the Rx/Tx 412, and may generate an image signal based on the image data. In more detail, for example, the driver 422 may generate an image signal corresponding to the received image data. In addition, the driver 422 may output the generated image signal to the display panel (500 of FIG. 1). The display panel (500 of FIG. 1) may be driven by the received image signal to then output an image.

The image analyzer 432 may analyze, for example, still image data supplied through the Rx/Tx 412 to determine a frame rate of an image to be output to the display panel (500 of FIG. 1), and may supply the analysis result to the interrupt generator 452.

That is, for example, in at least this example embodiment, the image analyzer 432 may not generate an interrupt (e.g., W_I of FIG. 4), but may supply only the image analysis result to the interrupt generator 452.

In at least some example embodiments of inventive concepts, the image analysis result may be a target count value of the counter 442 included in the interrupt generator 452.

The interrupt generator 452 may monitor whether a count value of the counter 442 reaches a target count value, and may generate an interrupt (e.g., W_I of FIG. 4) if the count value of the counter 442 reaches the target count value.

The generated interrupt (e.g., W_I of FIG. 4) is synchronized with a trigger signal (e.g., TE of FIG. 4) to then be supplied to the SoC device (100 of FIG. 1) through the Rx/Tx 412.

Figure 13:
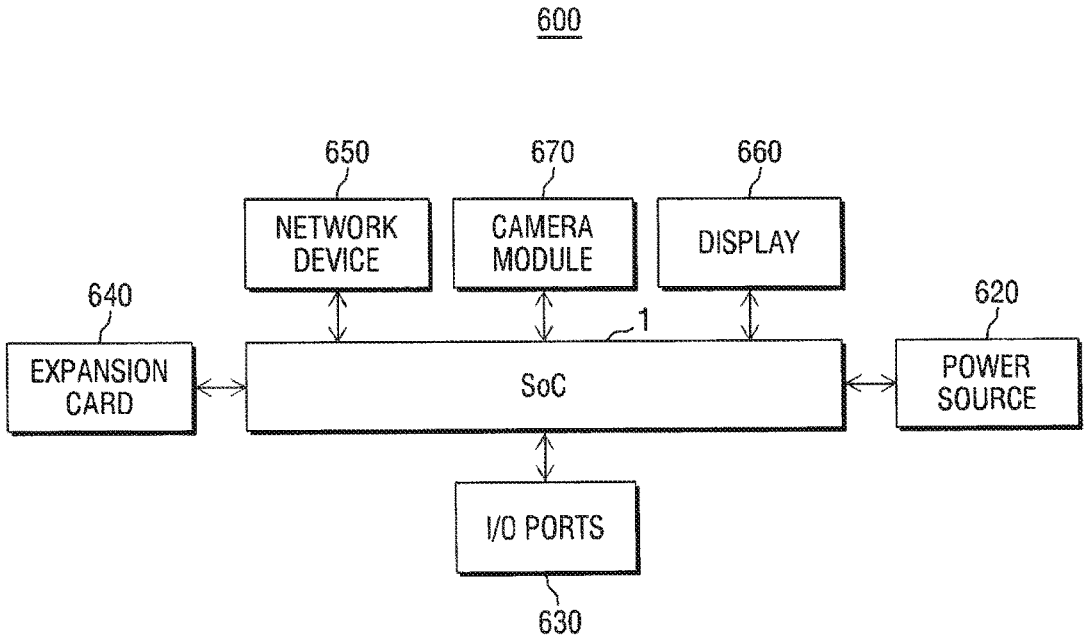
FIG. 13 is a block diagram of a SoC system according to another example embodiment of inventive concepts.
Figure 14:
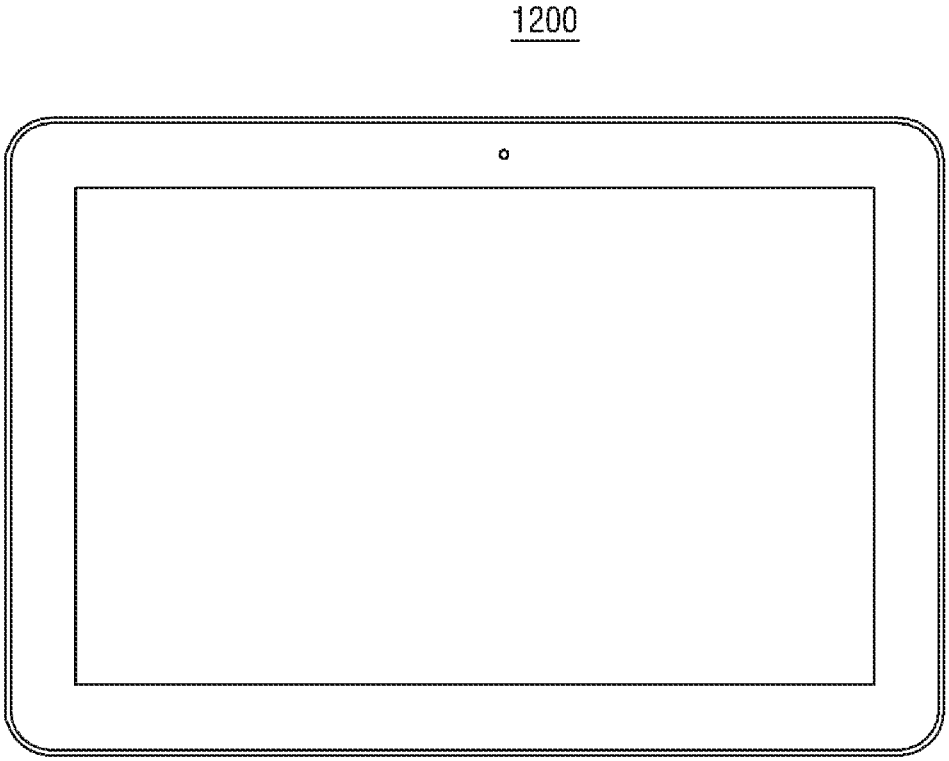
FIGS. 14 to 16 illustrate an example semiconductor system in which SoC systems according to one or more example embodiments of inventive concepts may be implemented.
Figure 15:
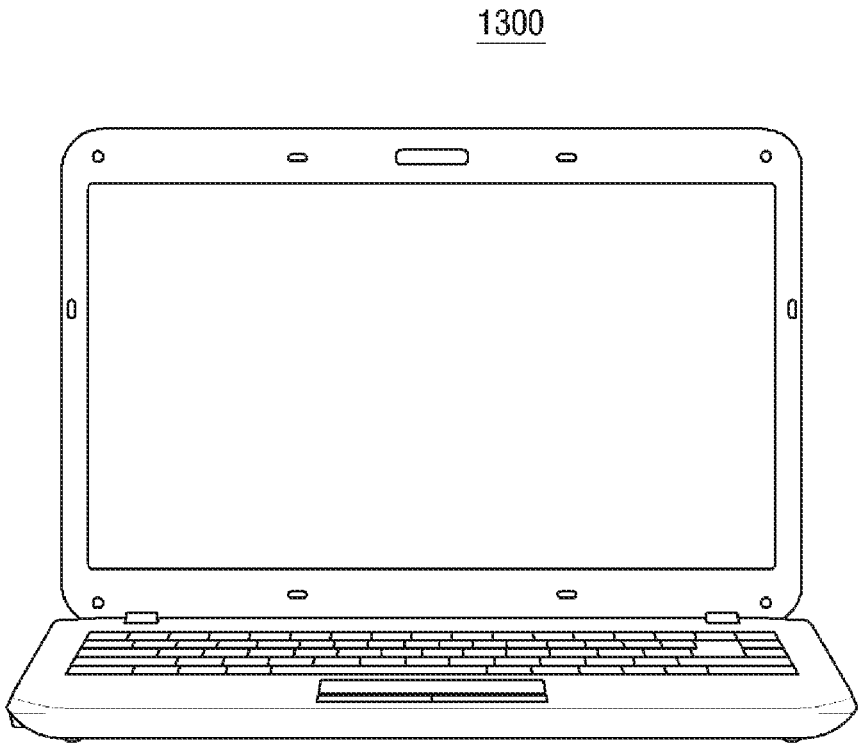
Figure 16:
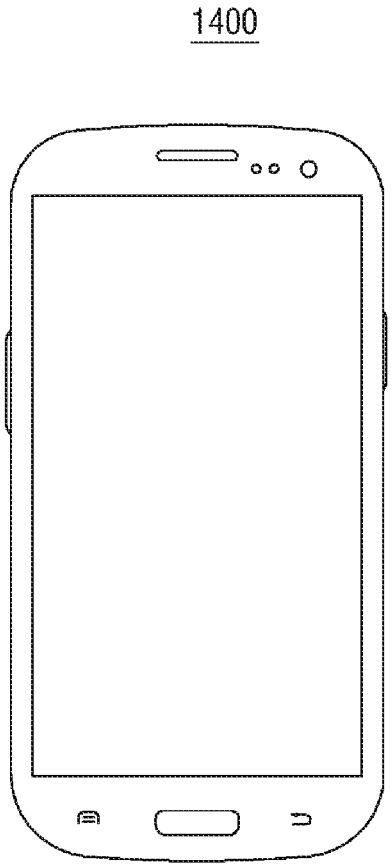

FIG. 13 is a block diagram of a SoC system according to another example embodiment of inventive concepts.

Referring to FIG. 13, the SoC system 600 according to another example embodiment of inventive concepts may include a SoC device 1, a power source 620, input/output (I/O) ports 630, an expansion card 640, a network device 650, a display 660, and a camera module 670.

The SoC device 1 may be substantially the same as the SoC device (100 of FIG. 1). The SoC device 1 may control the operation of at least one of the components 620 to 670.

The power source 620 may supply an operating voltage to at least one of the components 620 to 670.

The input/output (I/O) ports 630 may include ports capable of transmitting data to the SoC system 600 or transmitting the data output from the SoC system 600 to an external device.

The expansion card 640 may be implemented by, for example, a secure digital (SD) card or a multimedia card (MMC). In at least some example embodiments of inventive concepts, the expansion card 640 may be a subscriber identification module (SIM) card or a universal subscriber identity module (USIM) card.

The network device 650 may include a device that enables the SoC system 600 to be connected with a wireless network.

The display 660 displays data output from the input/output (I/O) ports 630, the expansion card 640, or the network device 650. The display 660 may be substantially the same as the display device 300 shown in FIG. 1.

The camera module 670 may be a module that converts an optical image into an electrical image. Therefore, the electrical image output from the camera module 670 may be stored in the SoC device 1 or the expansion card 640. In addition, the electrical image output from the camera module 670 may also be displayed on the display 660 under the control of the SoC device 1. In at least some example embodiments of inventive concepts, the camera module 670 may include an image sensor.

While inventive concepts have been shown and described with reference to some example embodiments thereof, it will be understood by those of ordinary skill in the art that various changes in form and details may be made therein without departing from the spirit and scope of inventive concepts as defined by the following claims. It is therefore desired that the example embodiments be considered in all respects as illustrative and not restrictive, reference being made to the appended claims rather than the foregoing description to indicate the scope of inventive concepts.

What is claimed is:

1. A system-on-chip (SoC) system comprising:

a SoC device configured to receive a trigger signal and a first interrupt signal, and to output image data based on the trigger signal and the first interrupt signal, wherein in a first mode, the SoC device is configured to transmit first image data in synchronization with a pulse of the trigger signal, in a second mode, the SoC device is configured to transmit second image data in synchronization with a pulse of the trigger signal only after receiving the first interrupt signal, and the trigger signal and the first interrupt signal are synchronized with each other; and a display configured to transmit the trigger signal and the first interrupt signal to the SoC device, and to output the first image data and the second image data in the first mode and the second mode, respectively, wherein the display is configured to transmit the first interrupt signal to the SoC device only in the second mode.

2. The SoC system of claim 1, wherein the first image data includes moving image data; and the second image data includes still image data.

3. The SoC system of claim 1, wherein a frequency of the trigger signal is greater than a frequency of the first interrupt signal.

4. The SoC system of claim 1, wherein the display is further configured to transmit a second signal to the SoC device only in the second mode to change the second mode to the first mode.

5. The SoC system of claim 1, wherein the display comprises an IGZO(Indium Gallium Zinc Oxide) panel.

6. The SoC system of claim 5, wherein the display is further configured to switch from the first mode to the second mode based on whether the SOC device has continuously transmitted the same image data p times, and p is a natural number greater than or equal to 2.

7. The SoC system of claim 6, wherein the display is further configured to transmit the first interrupt signal to the SoC device after switching from the first mode to the second mode.

8. The SoC system of claim 1, wherein a frame rate of the display in the first mode is greater than a frame rate of the display in the second mode.

9. The SoC system of claim 1, further comprising external memory storing the first image data and the second image data.

10. A system-on-chip (SoC) system comprising:

a SoC device configured to receive a trigger signal including successive first and second pulses, transmit first still image data in synchronization with the first pulse, and transmit second still image data in synchronization with the second pulse; and a display configured to transmit the trigger signal to the SoC device, receive the first still image data and the second still image data from the SoC device, output the first still image data in synchronization with the first pulse, output the second still image data in synchronization with the second pulse, generate a first interrupt signal in response to determining that the first still image data and the second still image data are identical, and transmit the first interrupt signal to the SoC device, wherein the SoC device is further configured to wait until the first interrupt signal is received, and transmit the second still image data to the display in response to receiving the first interrupt signal from the display, and wherein the trigger signal and the first interrupt signal are synchronized with each other.

11. The SoC system of claim 10, wherein the display comprises an IGZO(Indium Gallium Zinc Oxide) panel.

12. The SoC system of claim 10, wherein a frequency of the trigger signal is greater than a frequency of the first interrupt signal.

13. The SoC system of claim 10, wherein a frame rate of the display in a first mode is greater than a frame rate of the display in a second mode.

14. A system-on-chip (SoC) system comprising:

a SoC device configured to receive a trigger signal including successive first and second pulses, transmit first still image data in synchronization with the first pulse, and transmit second still image data in synchronization with the second pulse; and a display configured to transmit the trigger signal to the SoC device, receive the first still image data and the second still image data from the SoC device, output the first still image data in synchronization with the first pulse, output the second still image data in synchronization with the second pulse, generate a first interrupt signal in response to determining that the first still image data and the second still image data are identical, and transmit the first interrupt signal to the SoC device, wherein the SoC device is further configured to wait until the first interrupt signal is received, and transmit the second still image data to the display in response to receiving the first interrupt signal from the display, wherein the trigger signal includes third to fifth pulses that are continuous with the first and second pulses, and the SoC device is further configured to receive the first interrupt signal from the display in synchronization with the fourth pulse.

15. The SoC system of claim 14, wherein the SoC device is configured to not transmit any still image data to the display.

16. The SoC system of claim 14, wherein the SoC device is configured to transmit the second still image data to the display in synchronization with the fifth pulse.

17. The SoC system of claim 14, wherein the display is configured to generate a second interrupt signal when an event occurs after the fifth pulse has passed, and transmit the second interrupt signal to the SoC device.

18. The SoC system of claim 17, wherein the trigger signal includes successive sixth and seventh pulses after the fifth pulse; and the SoC device is configured to receive the second interrupt signal, transmit third still image data in synchronization with the sixth pulse, and transmit fourth still image data in synchronization with the seventh pulse.

* * * * *